US007340837B1

(12) United States Patent
Busse

(10) Patent No.: US 7,340,837 B1
(45) Date of Patent: Mar. 11, 2008

(54) FOLDING KNIFE WITH LOCKING BLADE

(76) Inventor: Jerry P. Busse, 11651 County Rd. 12, Wauseon, OH (US) 45567

( * ) Notice: Subject to any disclaimer, the term of this patent is extended or adjusted under 35 U.S.C. 154(b) by 0 days.

(21) Appl. No.: 11/410,880

(22) Filed: Apr. 25, 2006

Related U.S. Application Data

(63) Continuation of application No. 10/452,653, filed on Jun. 2, 2003, now Pat. No. 7,032,315.

(60) Provisional application No. 60/385,191, filed on May 31, 2002.

(51) Int. Cl.
*B26B 3/06* (2006.01)

(52) U.S. Cl. ..... 30/153; 30/160

(58) Field of Classification Search ..... 30/160–162, 30/153; D8/98–100
See application file for complete search history.

(56) References Cited

U.S. PATENT DOCUMENTS

| | | | | | |
|---|---|---|---|---|---|
| 1,454,665 | A | | 5/1923 | Bobek | |
| 1,614,949 | A | * | 1/1927 | Finley | 30/161 |
| 2,461,941 | A | * | 2/1949 | Sutton | 30/161 |
| 3,868,774 | A | * | 3/1975 | Miori | 30/161 |
| 4,240,201 | A | | 12/1980 | Sawby et al. | |
| 4,274,200 | A | | 6/1981 | Coder | |
| 4,351,126 | A | * | 9/1982 | Simonson | 43/5 |
| 4,451,982 | A | | 6/1984 | Collins | |
| 4,502,221 | A | | 3/1985 | Pittman | |
| 4,670,984 | A | | 6/1987 | Rickard | |
| 4,837,932 | A | | 6/1989 | Elsener | |
| 5,060,379 | A | | 10/1991 | Neely | |
| 5,095,624 | A | | 3/1992 | Ennis | |
| 5,111,581 | A | | 5/1992 | Collins | |
| 5,325,588 | A | * | 7/1994 | Rogers | 30/161 |
| 5,384,963 | A | | 1/1995 | Beermann | |
| 5,425,175 | A | | 6/1995 | Rogers | |
| 5,461,786 | A | | 10/1995 | Miller | |
| 5,615,484 | A | * | 4/1997 | Pittman | 30/161 |
| 5,722,168 | A | | 3/1998 | Huang | |
| 5,737,841 | A | | 4/1998 | McHenry et al. | |
| 5,815,927 | A | * | 10/1998 | Collins | 30/161 |
| 6,079,106 | A | * | 6/2000 | Vallotton | 30/161 |

(Continued)

OTHER PUBLICATIONS

The Bud K® Catalog, Early Fall 2003.*

*Primary Examiner*—Jason Prone
(74) *Attorney, Agent, or Firm*—Leatherwood Walker Todd & Mann, P.C.; Thomas W. Epting

(57) ABSTRACT

A folding knife having a blade locking member carried for sliding movement within a channel defined in the handle, the locking member being movable to a blade locking position when the blade is in an extended position. A spring, or other biasing means, such as an opposing magnet arrangement, provide a spring-like biasing of the locking member towards a blade locking. In one embodiment, the locking member extends substantially the full width of the handle and is accessible from either side of the knife handle. The locking member includes a ramp on the underside thereof for contacting a projection, or bump, on the rearward portion of the blade tang. An adjustable bushing is provided which allows for adjustment of the blade within the handle to provide for both ease of pivoting of the blade, while reducing any lateral play in the blade within the handle.

6 Claims, 13 Drawing Sheets

U.S. PATENT DOCUMENTS

| | | | | |
|---|---|---|---|---|
| 6,370,778 | B1 | 4/2002 | Conable | |
| 6,668,460 | B2 | 12/2003 | Feng | |
| 6,684,510 | B1 * | 2/2004 | Collins | 30/161 |
| 6,751,868 | B2 * | 6/2004 | Glesser | 30/161 |
| 7,032,315 | B1 * | 4/2006 | Busse | 30/160 |
| 7,059,053 | B2 * | 6/2006 | Sakai | 30/160 |
| 7,080,457 | B2 * | 7/2006 | Sullivan | 30/160 |
| 2004/0134075 | A1 * | 7/2004 | Chu | 30/161 |
| 2004/0154169 | A1 * | 8/2004 | McCann | 30/161 |

* cited by examiner

FOLDING KNIFE WITH LOCKING BLADE

This application claims benefit of U.S. Provisional application Ser. No. 60/385,191, filed May 31, 2002, and is a continuation of application Ser. No. 10/452,653, filed Jun. 2, 2003 now U.S. Pat. No. 7,032,315, and the entirety of the foregoing applications is incorporated herein by reference thereto.

BACKGROUND OF THE INVENTION

This invention relates generally to a folding knife having a blade which automatically becomes locked once moved to an extended position.

Folding knives come in two basic types. The first type includes a blade which may be moved between a closed or retracted position, substantially within the handle of the blade, and an open or extended position, extending outwardly from the handle. In this type of folding knife, the blade is not positively locked in place when in the extended position. In other words, by using some force, the blade can be moved from the extended position towards the retracted position without requiring release of a blade locking means. This type of pocket knife can be convenient for allowing the blade to be quickly opened and blade used for cutting, and then allows for the blade to be easily returned from the extended position to the retracted position. However, if care is not used in cutting with such a knife, or if the blade is used to apply force to an object in certain directions (and in particular if force is applied to the tip of the blade), the blade can inadvertently move from the open position towards the closed position, which can cause injury to the user.

The other type of folding knife includes a means for positively locking the blade once moved to the extended position. Such a locking mechanism may automatically lock the blade in the extended position, once the blade arrives at that position, or, the locking mechanism may require the user to selectively actuate the locking mechanism when the blade is desired to be locked in the open position for a particular circumstance.

Automatic locking mechanisms for locking the blade in the open position have often included an elongated lock bar pivotally connected to the backside of the blade handle. An elongated spring, such as a piano wire-type spring, may be used to urge upwardly on the rearward portion of the lock bar to force a locking tab (provided on the forward portion of the locking bar) into engagement with a notch or recess provided in the tang of the blade.

The notch in the tang is presented to the locking tab when the blade is in the extended position. In order to move the blade from the extended position to the retracted position, the locking tab is retracted from the notch in the tang by the user depressing the opposite end of the lock bar, against the upward force generated by the spring. The simultaneous depression of the lock bar in this manner with one hand, and pivoting of the blade to the retracted position with the other hand, thus allows for unlocking of the blade, and its return to the closed position.

Blade locking mechanisms which have been patented, include those disclosed in U.S. Pat. No. 5,461,786, issued to Miller; U.S. Pat. No. 4,240,201, issued to Sawby, et al.; U.S. Pat. No. 4,274,200, issued to Coder; U.S. Pat. No. 4,502,221, issued to Pittman; U.S. Pat. No. 4,670,984, issued to Rickard; U.S. Pat. No. 4,837,932, issued to Elsener; U.S. Pat. No. 5,060,379, issued to Neely; U.S. Pat. No. 5,737,841, issued to McHenry, et al.; U.S. Pat. No. 6,370,778 B1, issued to Conable; U.S. Pat. No. 5,425,275, issued to Rogers; and U.S. Pat. No. 5,111,581, issued to Collins.

U.S. Pat. No. 4,451,982, also issued to Collins, discloses a bolt action knife having a sliding bolt carried within the handle. The bolt includes a tapered forward portion for engaging the tang of the blade, once the blade is moved to the extended position. The forward end of the bolt acts as a wedge between the tang and the handle in order to lock the blade in the extended position. Unlocking of the blade requires retraction of the bolt, against the force of a spring, a sufficient distance such that the bolt clears the tang to allow the blade to be retracted.

Even in view of the foregoing designs, however, a need still remains for a folding knife having a blocking mechanism of relatively high strength and accessibility for use in automatically locking a blade upon movement of the blade to the extended position.

SUMMARY OF THE INVENTION

It is, therefore, the principal object of this invention to provide a folding knife having an improved blade locking mechanism.

Another object of the present invention is to provide a folding knife having a blade which automatically becomes locked upon the blade being moved to an open, or extended, position.

Another object of the present invention is to provide a folding knife having a blade locking mechanism with an improved means for preventing the blade from becoming inadvertently unlocked.

Another object of the present invention is to provide a folding knife having a locking mechanism having means for unlocking the lock, accessible from either side of the knife handle.

Another object of the present invention is to provide a folding knife having means for securing the blade in the retracted position within the handle.

Another object of the present invention is to provide a method of operation of a folding knife constructed in accordance with the present invention.

Generally, the present invention addresses the foregoing objects by providing a folding knife having a blade pivotally connected to a handle for pivoting between a retracted position and an extended position with respect to the handle. The blade includes a tang having a locking profile and an engagement profile.

A locking member is carried for sliding movement within a channel defined in the handle, the locking member being movable between a locking position and an engagement position and a retracted position. Movement of the locking member to the retracted position is preferably performed against the force of a spring, or other biasing means, such as an opposing magnet arrangement, wherein magnets are oriented for repealing one another to provide a spring-like biasing of the locking member towards the locking and engagement positions.

When the blade is in the retracted position, the locking member is in the engagement position, engaging the engagement profile defined on the blade. Upon the blade being pivoted to the extended position, the locking member moves to the locking position and cooperates with the locking profile on the blade to automatically lock the blade in the extended position.

More specifically, the present invention includes a locking member which extends substantially the full width of the handle and is accessible from either side of the knife handle.

The locking member includes a ramp on the underside for contacting a projection, or bump, on the rearward portion of the blade tang. In one preferred embodiment, the spring used to bias the locking member towards the locking and engagement positions is a coil spring, although other types of springs, such as a wave-shaped or an "omega"-shaped spring, could also be used to perform this function.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
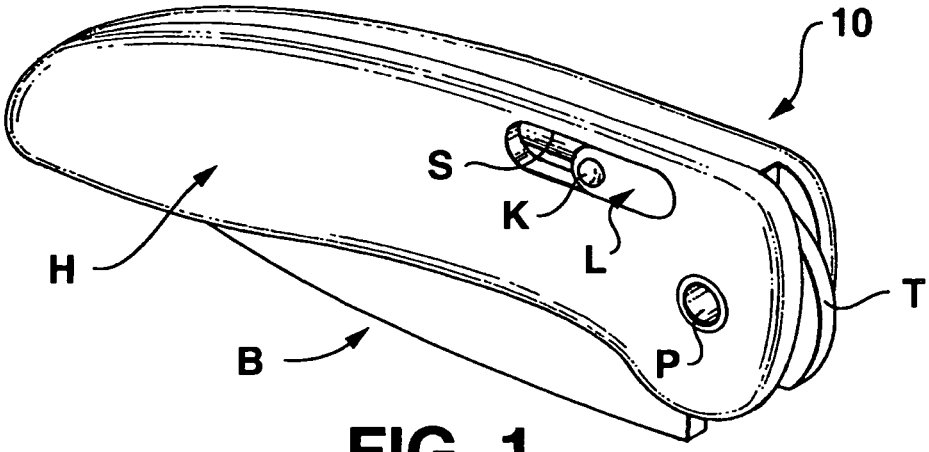
FIG. 1 is a perspective view of a locking folding knife constructed in accordance with the present invention, with the blade shown in a retracted position, and the handle being of a one-piece construction.

The accompanying drawings and the description which follows set forth this invention in its preferred embodiment. However, it is contemplated that persons generally familiar with folding knives will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the assembly, construction, and method of use of the locking folding knife of the present invention are discussed in detail. The locking folding knife is indicated generally in the figures by reference character 10.

Figure 2:
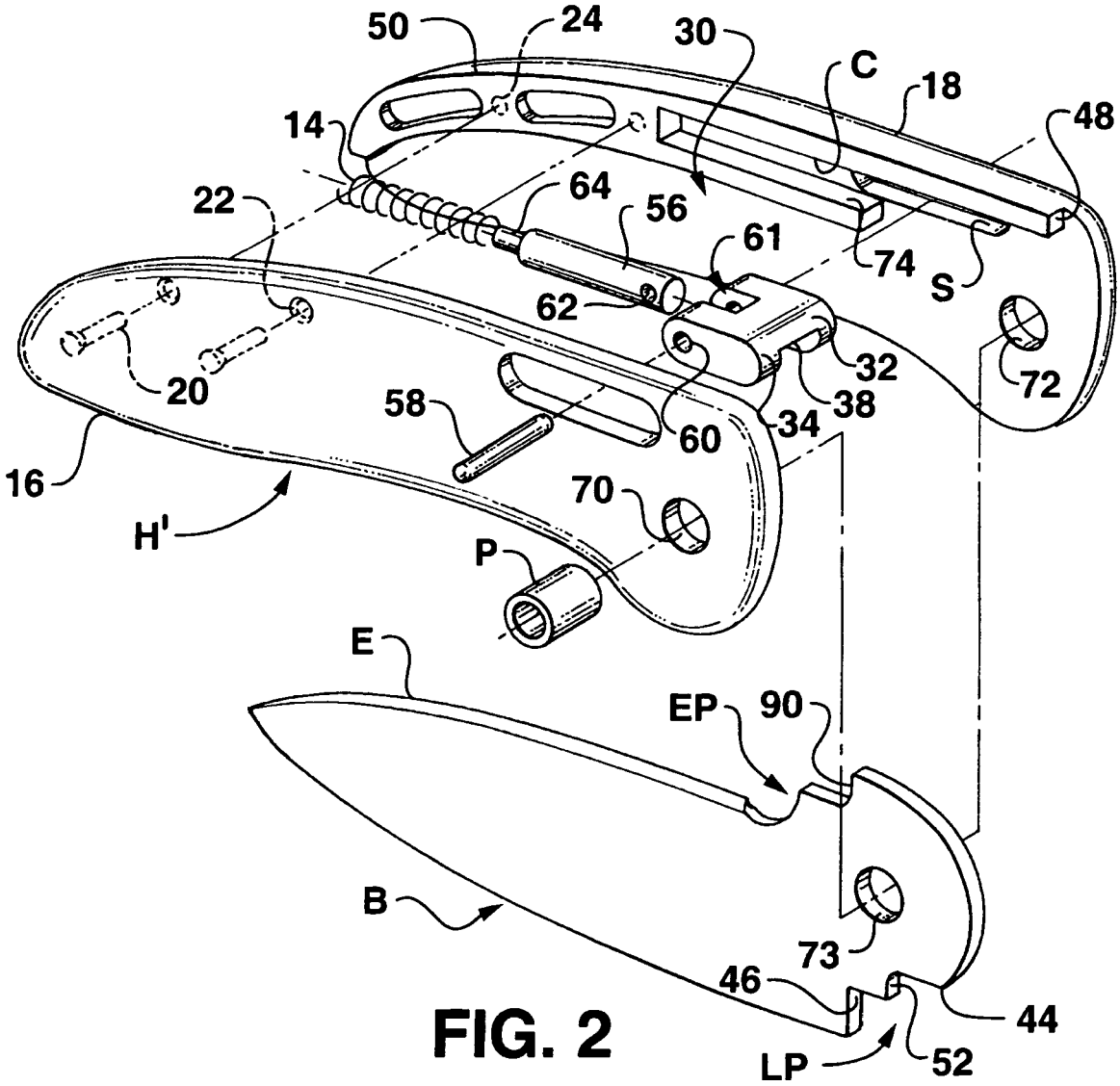
FIG. 2 is an exploded view of a locking folding knife constructed in accordance with the present invention, and is an alternate embodiment of the locking folding knife shown in FIG. 1, in this instance the handle being formed using separate handle members joined to one another.

Turning to FIG. 1 of the drawings, folding knife 10 is illustrated in one of the preferred embodiments of the present invention, and includes a one piece handle, generally H, to which a blade, generally B, is pivotally attached using a pivotal connector, generally P. Blade B includes a cutting edge, generally E (FIG. 2), and a tang portion, generally T. A locking mechanism, generally L, is carried in handle H within a channel, generally C (FIG. 2), and is accessible from either side of handle H by virtue of slots S defined in each side of handle H. Projections, or knobs (only one shown), generally K, are provided on locking member L, and preferably extend to or outwardly from each side of handle H, such that a user may engage a knob K from either side of handle H in order to engage locking mechanism L, and to retract it rearwardly in slots S, against the force of a spring, such as coil spring 14 (FIG. 2). It is to be understood that, although not shown, biasing members other than coil spring 14 could be used, such as a wave-shaped or an "omega"-shaped spring.

FIG. 2 illustrates an alternate embodiment handle construction, generally H', wherein handle H' comprises two handle members 16, 18 which are attached to one another through use of screws 20, which pass through holes 22 in handle 16 and which are received in threaded bores 24 in handle member 18. When handle members 16, 18 are combined in this manner, a blade cavity, generally 30, is formed for receipt of blade B when blade B is in a retracted position, as shown in FIGS. 1, 3C, and 3E.

Locking mechanism L includes several components. A locking member 32 includes a curved forward nose portion 34 which extends transversely along the front of locking member 32. Locking member 32 preferably extends the full width of handle H in order to provide a substantial-sized transversely extending blade block, relative to the size of the knife, for securing blade B in the extended position. By spanning between slots S and generally the full width of handle H, a significant amount of force can be withstood and distributed by the large locking member 32 to handle H, thereby providing a rugged and heavy-duty locking mechanism for blade B.

Locking member 32 includes on its underside a ramp, generally 38, which, when locking member 32 is advanced due to the spring pressure of spring 14, rides upwardly on the locking profile, generally LP, of tang T. As shown in FIG. 3A, locking profile LP preferably includes a rounded upstanding projection, generally 44 (adjacent recess 45), upon which ramp 38 rides, as locking member 32 engages the locking profile LP.

Blade B also includes a stop 46 on tang T which engages with stop 48 on the back 50 of handle H, and tang T further includes an abutment 52 against which nose portion 34 of locking member 32 abuts, when locking member 32 is in the locking position.

The spring force of spring 14 is delivered to locking member 32 via a connecting arm 56, which connects to locking member 32 with a wrist pin 58 received in bores 60 of in yoke 61 of locking member 32 and bore 62 of connecting arm 56. Connecting arm 56 includes a tail piece 64, about which coil spring 14 encircles, in order to properly maintain the line of force delivered by coil spring 14 in biasing locking member 32 towards the locking and engagement positions. It is to be noted that knobs K are preferably formed by the extreme ends of wrist pin 58.

Referring to the alternate embodiment shown in FIG. 2, handle portions 16 and 18, in addition to being fastened together using screws 20, may also be held together through an interference fit of pivot member P received in bores 70, 72, respectively of handle members 16, 18, particularly in the case where such handle members are constructed of metal. Blade B receives pivot member P in bore 73.

Figure 3B:
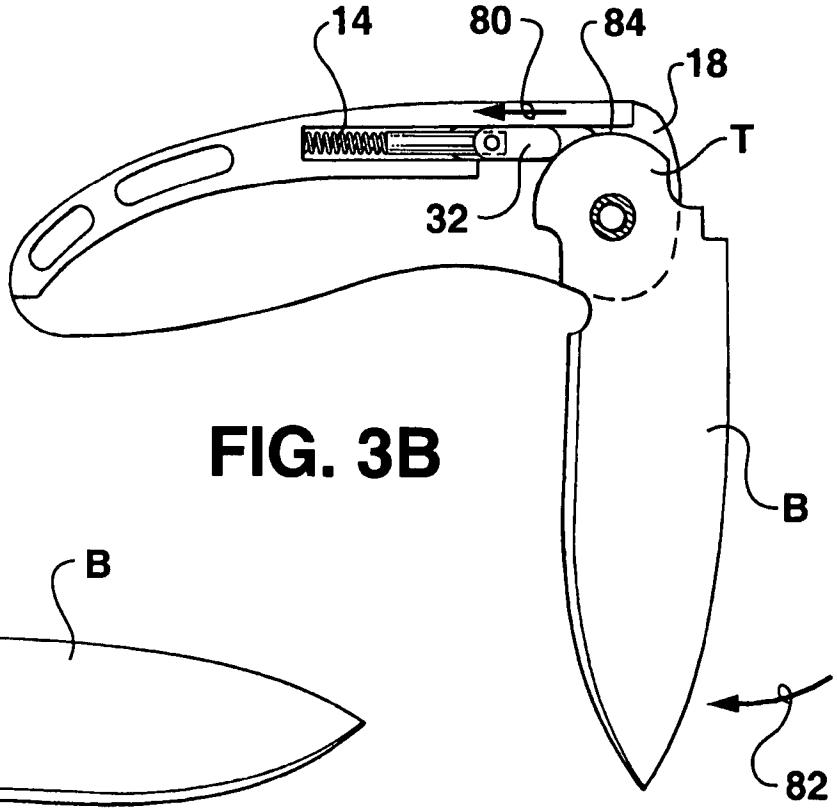
FIG. 3B is a sectional view like that of FIG. 3A, showing the blade at an intermediate position between the extended and retracted positions.
Figure 3C:
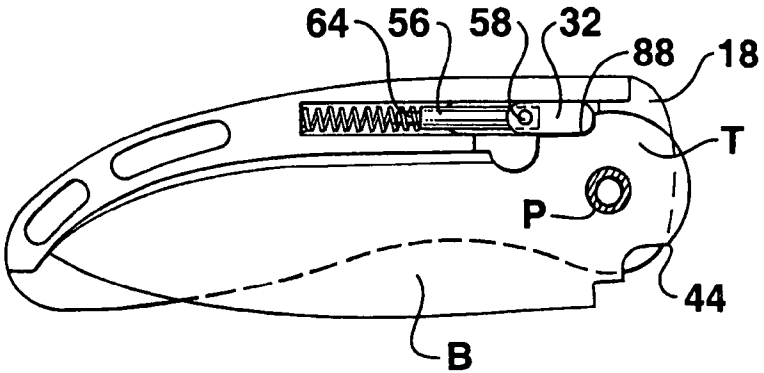
FIG. 3C is a sectional view like that of FIG. 3A, with the blade being shown in a retracted position.
Figure 3A:
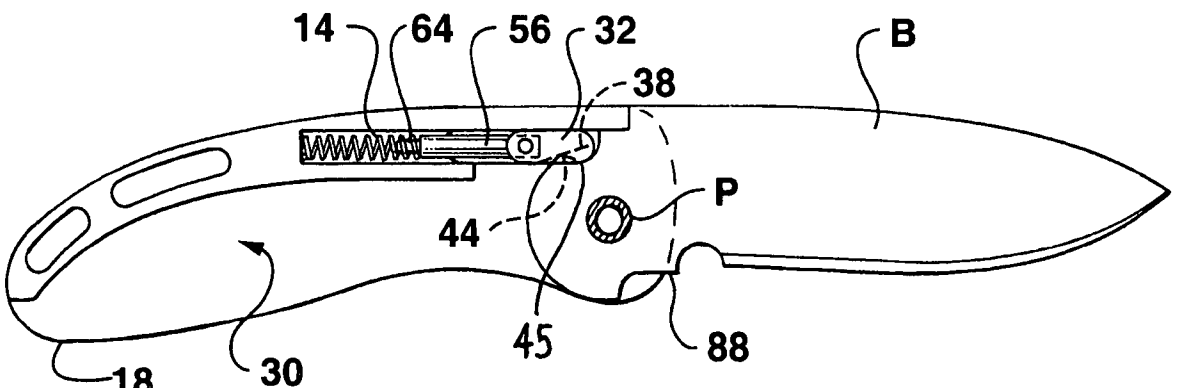
FIG. 3A is a sectional view of the locking folding knives illustrated in FIGS. 1 and 2, showing the blade in the extended position.

Turning now to FIGS. 3A through 3C, the operation and method of use of folding knife 10 is illustrated. Beginning with FIG. 3A, blade B is shown in an extended position. In this position, it can be seen that locking member 32 is advanced forward, and is in the locking position, in engagement with locking profile LP of blade B. In particular, projection 44 is received by locking member 32, and ramp 38 of locking member 32 bears against projection 44.

In FIG. 3B, blade B has been moved to an intermediate position, between the extended position shown in FIG. 3A, and the retracted position shown in FIG. 3C. Channel C includes a floor, or race, 74 on which locking mechanism L slides during movement between the retracted position and the locking and engagement positions. In order for blade B to be in the position shown in FIG. 3A, the user would be required to manually pull locking member 32 rearwardly in the direction of arrow 80, preferably by grasping one or more of knobs K, in order to allow nose 34 of locking member 32 to clear locking profile LP of blade B.

Once such clearance is obtained, the user would then press on blade B in a direction towards cavity 30 in order to pivot blade B in the direction of arrow 82. Once blade B begins to pivot, the user could then release locking member 32, and the forward end 34 of locking member 32 would simply ride on the arcuate profile 84 of tang T. The bearing of locking member 32 against arcuate profile 84 provides resistance to the closing of blade B, and such resistance, while easily overcome by the user, is desirable in order to provide more control to the closing of the blade, and to also prevent the blade from swinging freely as it moves from the extended to the retracted positions. It is to be understood, however, that should the user desire to allow the blade to swing freely, the user could simply maintain pull on locking member 32 such that locking member 32 does not contact arcuate profile 84.

FIG. 3C illustrates blade B in the retracted position. In this position, locking member 32 is in engagement profile, generally EP, of blade B. Engagement profile includes a flat 88 onto which locking member 32 slides automatically once blade B reaches the retracted, or "home" position. In this position, the nose portion 34 of locking member 32 bears against stop 90 of tang T. By locking member 32 being in this engagement position, blade B is secured in blade cavity 30 and is prevented from falling, or "flopping," from handle H when blade B is not in use. In order to move blade B to the extended position, the user would pull on blade B, and stop 90 would force locking member 32 rearwardly until stop 90 clears nose portion 34 of locking member 32, and at that point, blade B would be in an intermediate position, such as discussed above in regards to FIG. 3B.

FIG. 3E illustrates an alternate embodiment blade, generally B'. Blade B' differs from blade B, discussed above, in that it does not have the projection 44. Instead, locking profile LP' includes a flat 96, similar to the flat 88 diametrically opposed on tang T. In this embodiment, no ramp 38 would be required on a locking member 32'. However, locking member 32' would operate similarly as does locking member 32 in order to automatically lock blade B' in the extended position, once blade B' arrives at such extended position. Operation of locking member 32' for engaging blade B' when blade B' is retracted would be identical to that discussed above with regards to the embodiment of FIG. 3C.

Figure 3D:
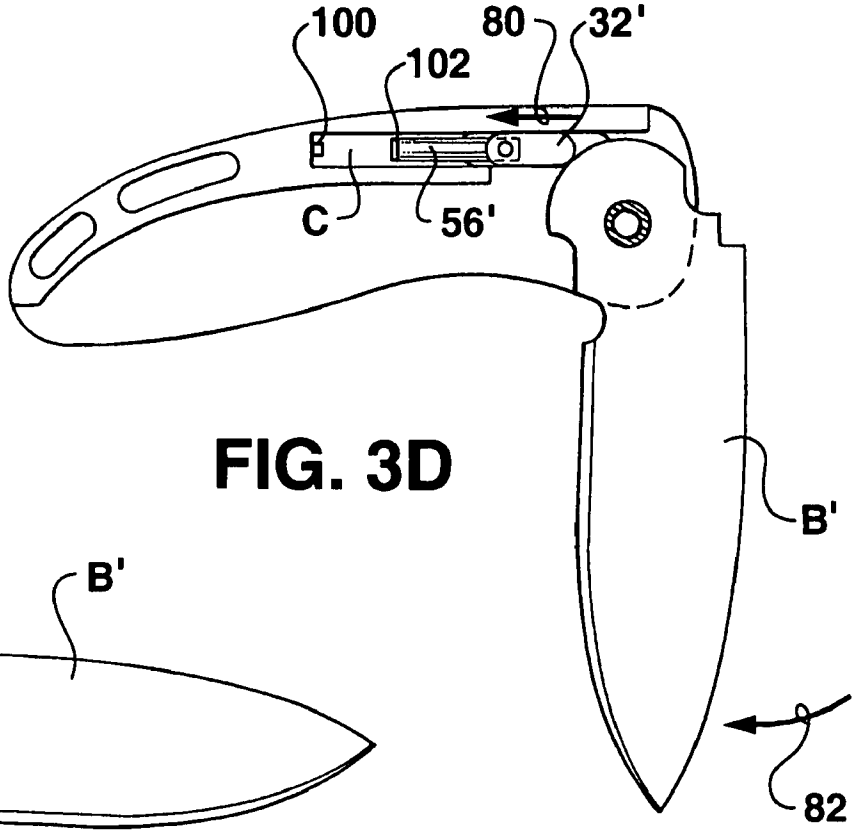
FIG. 3D is a sectional view of an alternate embodiment of a folding knife constructed in accordance with the present invention, wherein magnets are provided for biasing a locking member towards a locking position or engagement position, instead of the coil spring shown in the other figures.
Figure 3E:
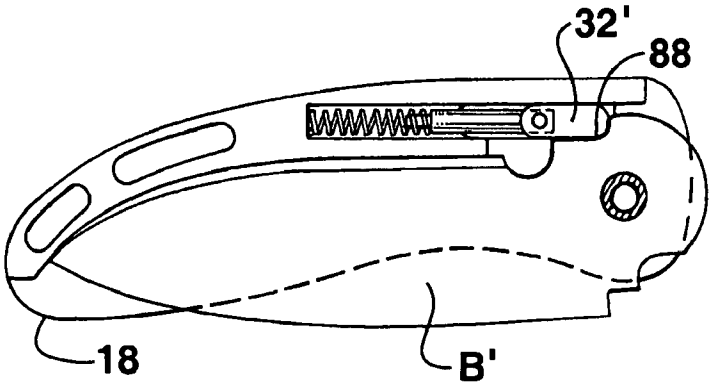
FIG. 3E is a sectional view of an alternate embodiment of a folding knife constructed in accordance with the present invention, wherein the blade is shown in the retracted position, and wherein the locking profile on the blade differs from the locking profile shown in the figures discussed above.
Figure 3F:
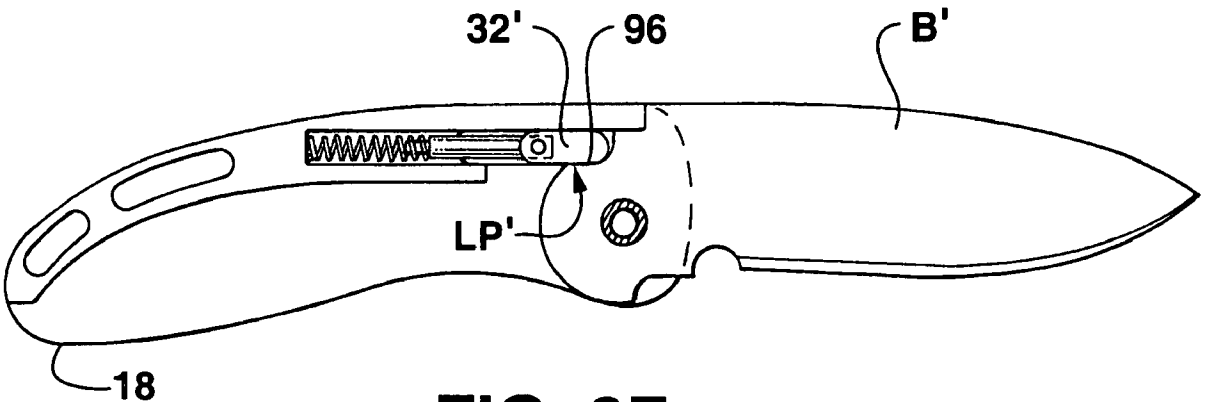
FIG. 3F is a sectional view of the alternate embodiment locking folding knife shown in FIG. 3E, with the blade being in the extended position.

FIG. 3D illustrates a further embodiment of the locking knife of the present invention. In this embodiment, spring 14 has been eliminated, and in its place two magnets 100, 102 have been provided. Magnet 100 is attached in channel C at the closed end thereof, and magnet 102 is attached to the rearward end of wrist pin 56'. Magnets 100 and 102 are positioned so that they repel one another. In other words, magnets 100, 102 would be positioned such that the south pole of each magnet faces one another, or, the north pole of each magnet faces one another. This repulsion force acts like a spring force to constantly bias locking member 32' towards the locking and engagement positions. To retract the locking member 32 from such positions, the user would simply pull back on locking member 32', in a manner as discussed above, against the repulsive force of magnets 100, 102.

From the foregoing, it can be seen that the present invention provides a folding knife having a strengthened, transversely extending locking mechanism, actuatable from either side of the knife's handle.

Figure 4:
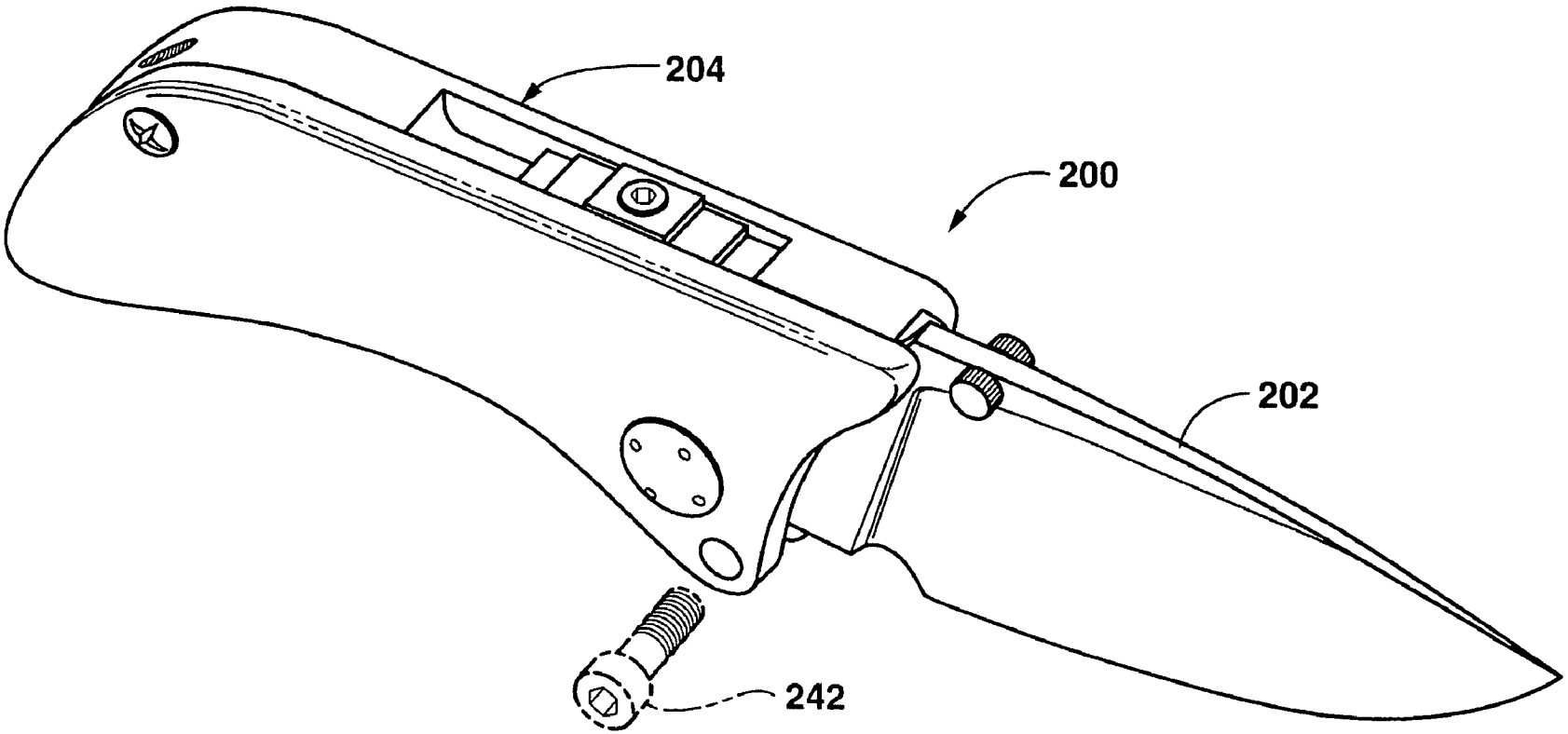
FIG. 4 is a perspective view of another alternate embodiment locking folding knife constructed in accordance with the present invention, with the blade being in the extended position.
Figure 5:
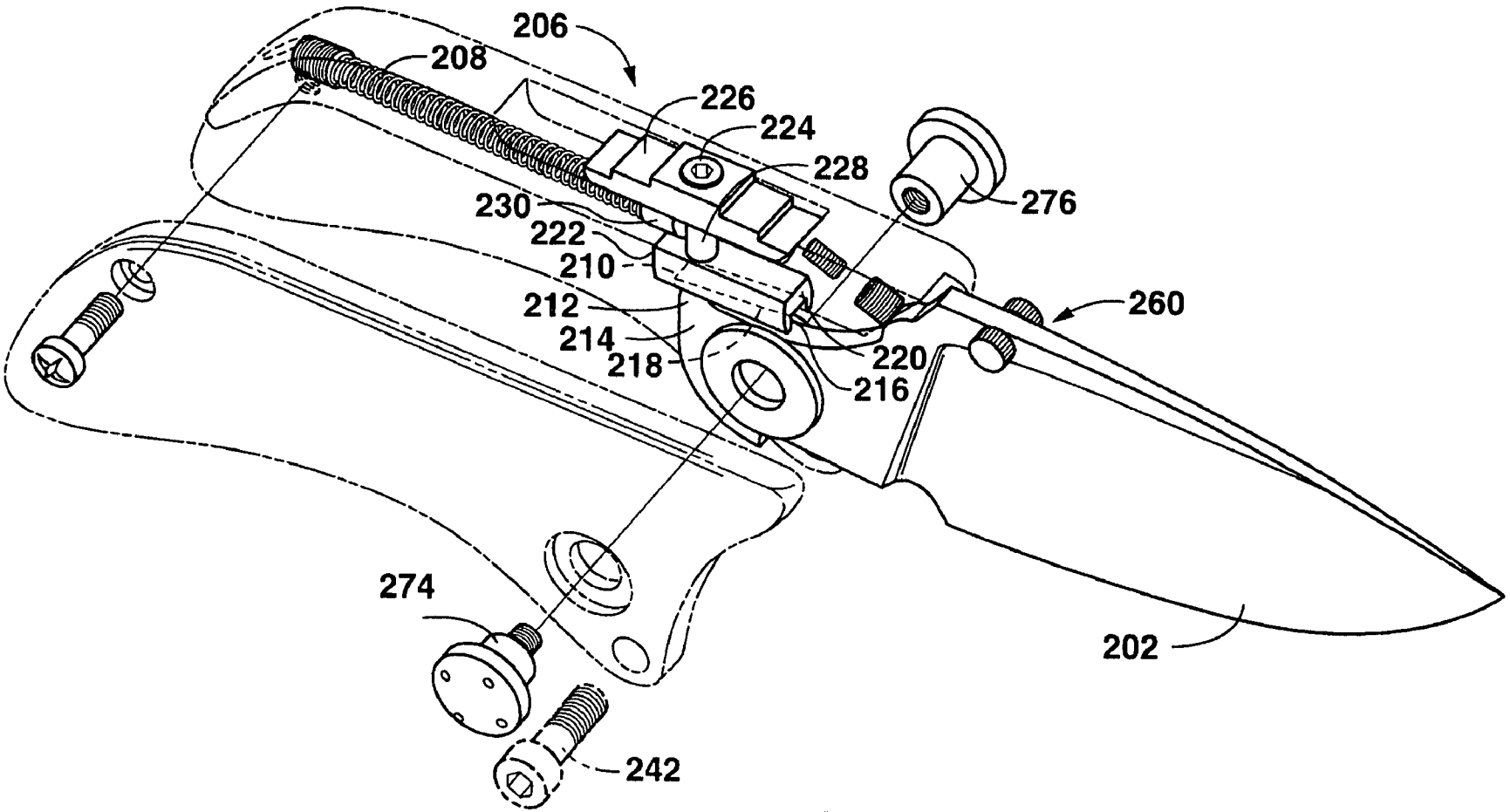
FIG. 5 is a partial exploded view of the alternate embodiment locking folding knife shown in FIG. 4.
Figure 6:
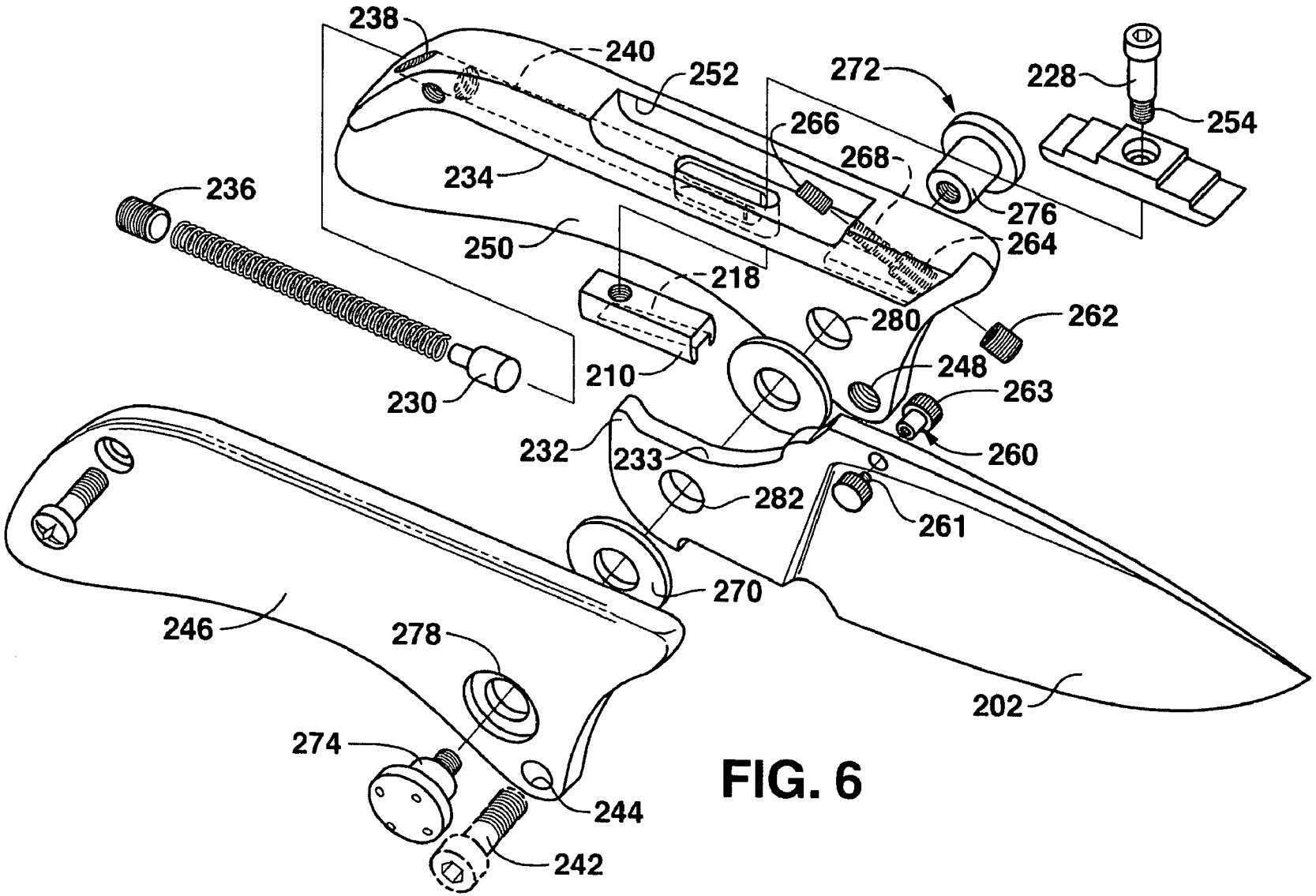
FIG. 6 is an exploded view of the alternate embodiment locking folding knife shown in FIG. 4.
Figure 7A:
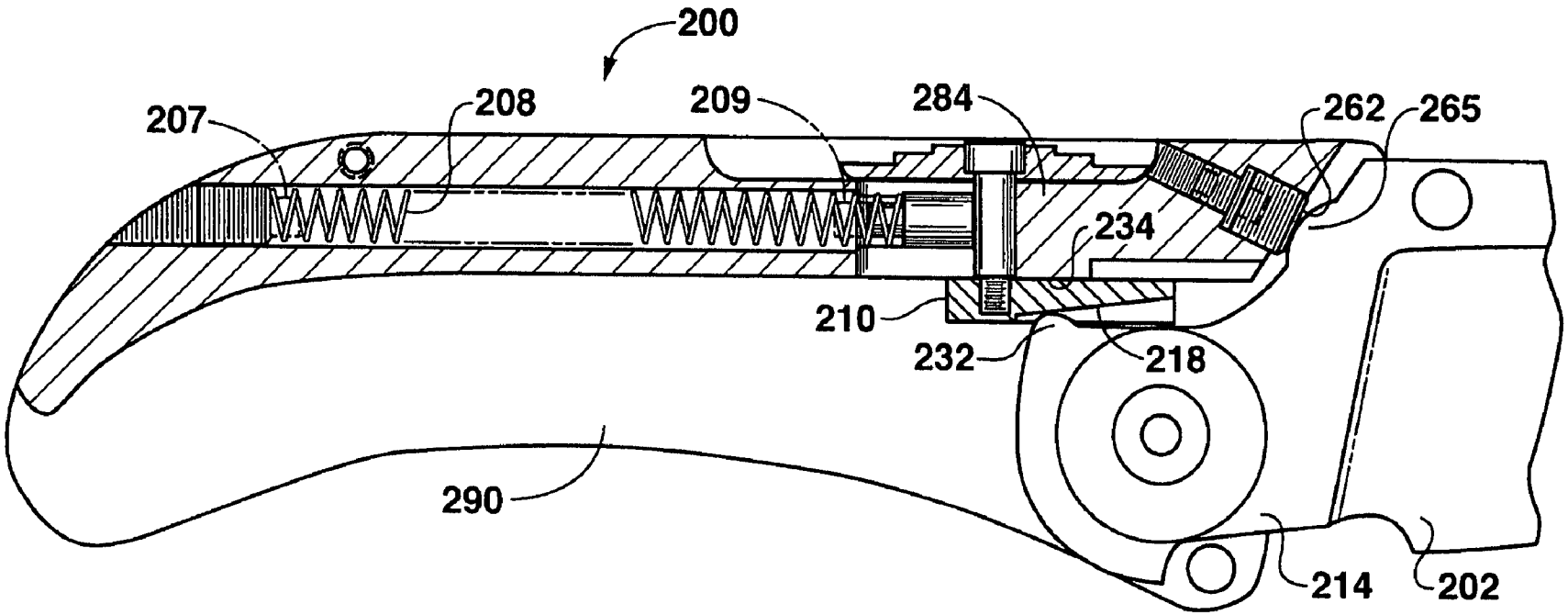
FIG. 7A is a sectional view of the alternate embodiment locking folding knife shown in FIG. 4, with the blade being in the extended position.
Figure 7B:
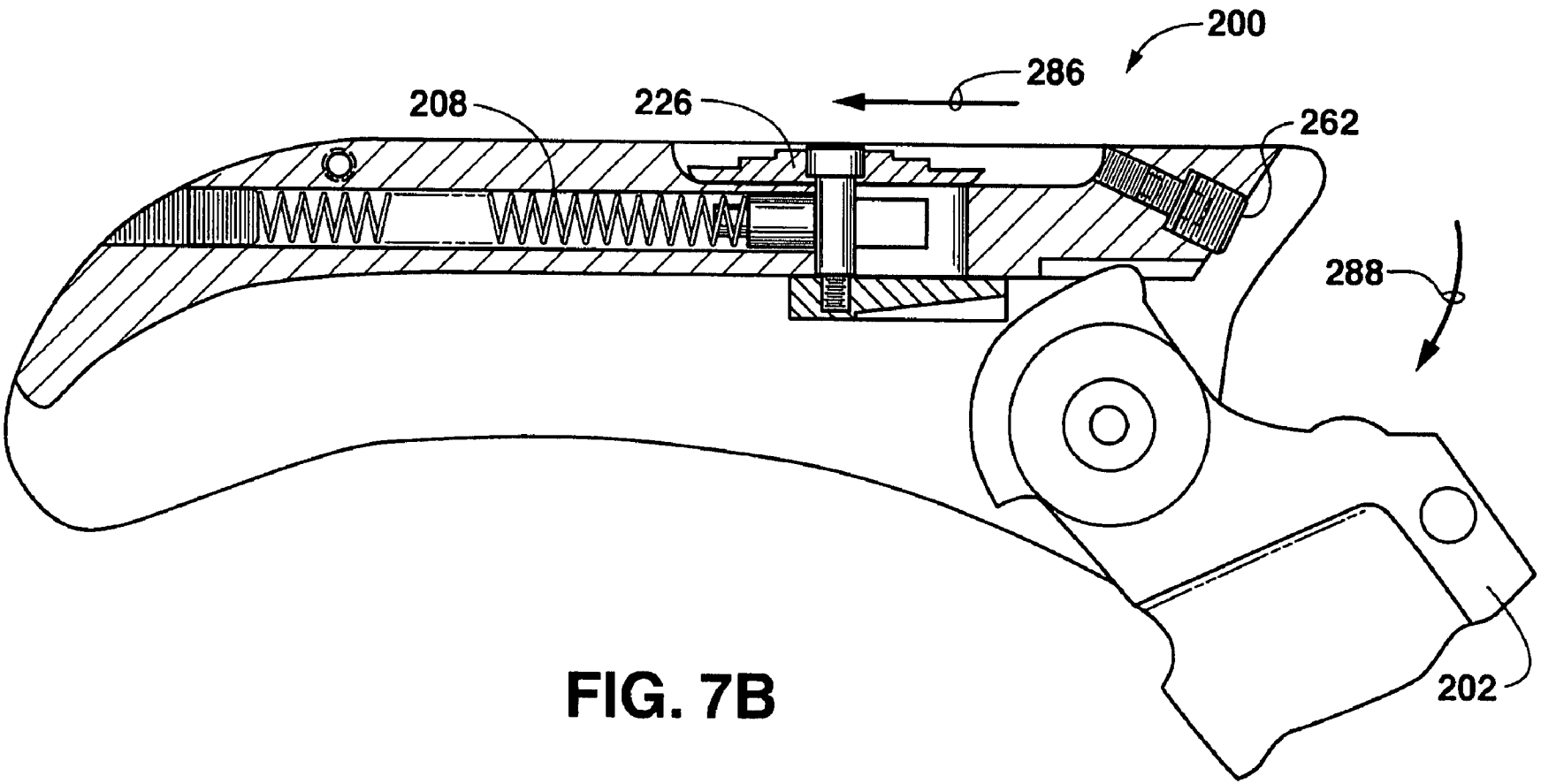
FIG. 7B is a sectional view of the alternate embodiment locking folding knife shown in FIG. 4, with the blade being in an intermediate position between the extended and retracted positions.
Figure 7C:
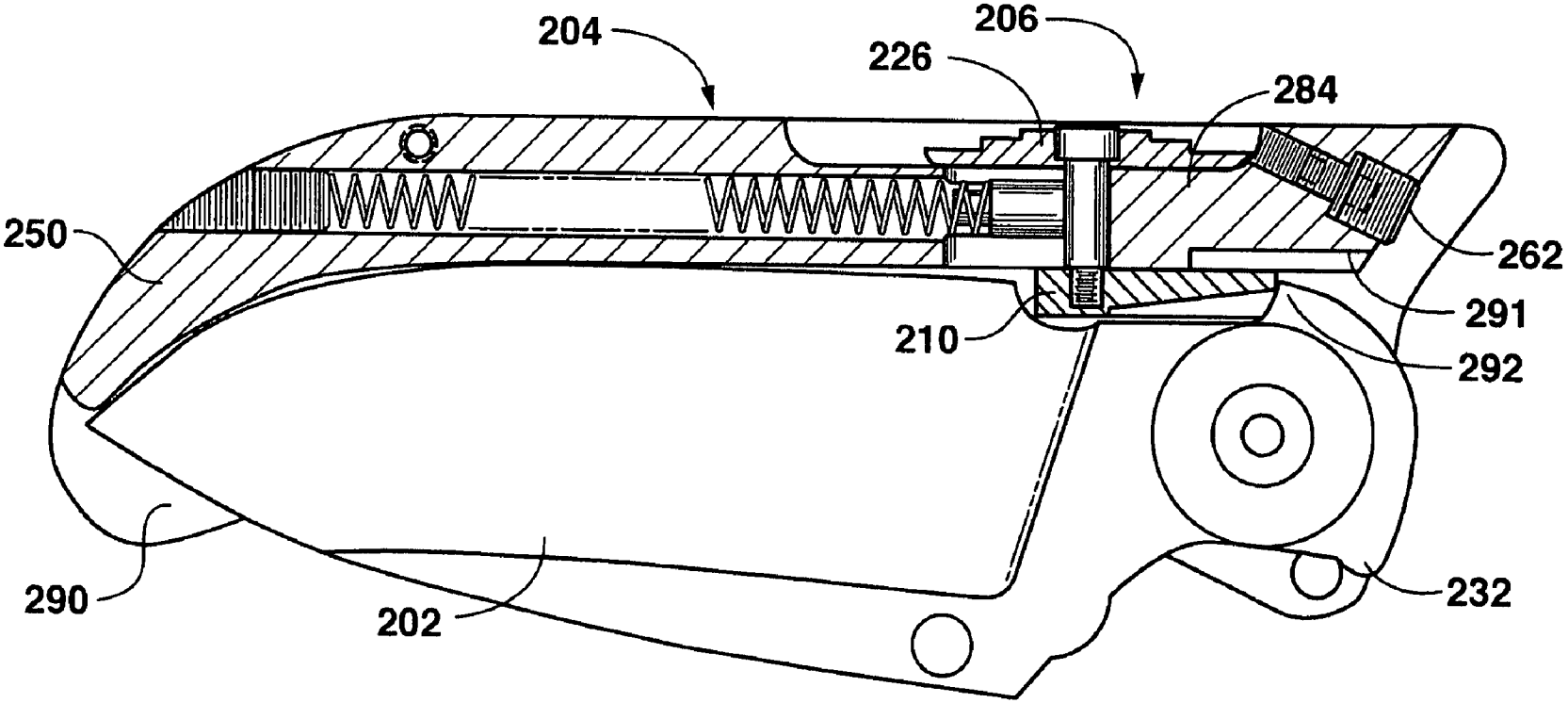
FIG. 7C is a sectional view of the alternate embodiment locking folding knife shown in FIG. 4, with the blade being in the retracted position.

Turning to FIGS. 4 through 7C, a further alternate embodiment of 200 locking folding knife of the present invention is shown. Knife 200 includes a blade 202, shown in the extended position in FIG. 4. Blade 202 is pivotally connected to handle, generally 204, which could be a unitary, one-piece construction, or made of two or more pieces, as shown in FIG. 4. Blade 202 is movable between the extended position, as shown in FIGS. 4 through 7A, through an intermediate position, as shown in FIG. 7B, to a retracted position as shown in FIG. 7C.

As shown in FIG. 5, knife 200, like knife 10, includes a spring-biased blade locking arrangement, generally 206. Although a coil spring 208 is shown as the biasing spring for the locking arrangement 206, it is to be understood, that other spring types could be used, such as a wave-shaped spring, or an "omega" shaped spring (neither shown) or, magnets 207, 209 (FIG. 7A), similar to magnets 100, 102 illustrated in FIG. 3D could also be used either alone as the biasing means, or in combination with a coil spring or other spring. Preferably, magnets 207, 209 (and, magnets 100, 102) would be rare earth magnets, and if such magnets 207, 209 were used, screw 236 and piston would preferably be constructed of a non-magnetic material, such as titanium, aluminum, stainless steel, or the like.

Locking arrangement 206 includes a lock block 210 for engaging the rearward portion 212 of the tang 214 of the blade 202, when the blade 202 is in the extended position, as shown in FIG. 5. Lock block 210 includes a channel 216 in the underside thereof, the upper surface of channel 216 being a ramp 218 downwardly sloped from the forward end 220 of the lock block 210 towards the rearward end 222 of lock block 210. A thumb button screw 224 extends upwardly from lock block 210 and connects a thumb button 226 to lock block 210. Extending generally perpendicularly with respect to a shoulder 228 of screw 224 is a piston member 230, which is spring-biased for urging locking arrangement 206 forward, similarly as spring 14 urges locking member 32 of knife 10, discussed above.

Preferably, lock block 210 spans substantially the entire width of handle 204, but, in one preferred embodiment, remains substantially enclosed within handle 204. The ramp 218 on the lower portion of lock block 210 engages and rides along the top of a projection, or bump, 232 adjacent a recess 233 (FIG. 6) extending upwardly on the end of tang 214. This bump 232 is similar to the bump 44 shown in FIG. 3A above, and the engagement of ramp 218 against bump 232 acts as a wedge between the tang 214 of blade 202 and the spine, generally 234, of handle 204.

A spring plug 236 is provided at the extreme end of handle 204, within a threaded bore 238, and allows for spring 208 to be inserted into channel 240 through bore 238, and then maintained in place once spring plug 238 is screwed into bore 238.

As shown in FIGS. 4 through 6, a screw 242 is provided for receipt within a bore 244 in handle member 246 and in a threaded bore 248 within handle member 250 for further absolute locking of blade 202 in the extended position, when knife 200 is to be used as a fixed-blade knife, such as if knife 200 is to be attached to a shaft, stick, or the like in order to form a spear or javelin. When not in use, screw 242 can be stored in a compartment (not shown) in handle 204.

Bump 232 preferably provides a generally vertically directed upward force on the ramp 218 in the event a downward force is applied to the tip of blade 202. This prevents inadvertent closure of blade 202 to the retracted position. In the event the bump 232 should wear over time, the ramp 218 portion of lock block 210 would simply ride further forward, under the pressure of spring 208, to continue to maintain a secure locking of blade 202 in the extended position.

Thumb button 226 is configured to move linearly within a channel 252 in the upper top, or back, portion of handle member 250. Thumb bolt screw 224, having a threaded end 254 and shoulder 228 moves, within slot 256 as thumb button 226 moves within channel 252 during the movement of thumb button 224. Thumb button 224 moves forward to automatically lock blade 202 in an extended position (once blade 202 is moved to the extended position), and button 224 is manually pulled rearwardly, in order to unlock blade 202. Spring 208 is carried within a channel 258 defined in handle member 250.

Blade 202 can include posts 260 for allowing a user to open blade 202 from the retraced position using only one hand, with the user's thumb or finger engaging post 260 during pivoting of the blade outwardly. Post 260 includes a male member 261 and a female member 263.

A blade stop screw 262 is provided in a threaded opening 264 in a forward portion of handle 204. Blade stop screw 262 contacts with a projection 265 on the rearward portion of blade 202 when blade 202 is in the extended position. By turning of blade stop screw 262 within threaded bore 264, play, which may exist between the blade 202 and handle 204 when blade 202 is in the extended position, can be reduced or eliminated. Blade stop screw 262 also allows for adjustment, if necessary, of the amount and location of contact bump 232 makes with lock block 210. Stop screw plug 266 is threadedly engaged in and plugs bore 268 which may be formed during manufacturing of handle member 204, and also blocks access to blade stop screw 262.

Washers 270 placed on either side of tang portion 214 facilitate smooth movement of blade 202 with respect to handle 204 as it pivots between the retracted and extended positions, and a pivot bushing, generally 272, having a male member 274 and a female member 276 passes between bores 278 and 280 in handle members 246 and 250, respectively, and serve as a pivot axle received by bore 282 of blade 202.

FIG. 7A shows lock block 210 in its forwardmost position, with ramp 218 engaging bump 232 of tang 214. This wedge arrangement securely locks blade 202 in the extended position. Note that lock block 210 is constrained from upward movement by spine 234 of body portion 284 of handle member 250. Note also contact of blade stop screw 262 with projection 264.

FIG. 7B illustrates blade 202 in an intermediate position, which is allowed once thumb button 226 has been pulled rearwardly in the direction of arrow 286, thereby permitting the pivoting of blade 202 by the user in the direction of arrow 288.

FIG. 7C illustrates blade 202 in a retracted position within a blade cavity 290 of handle 204. In this position, lock arrangement 206 is again advanced to its forwardmost position. Body portion 284 of handle member 250 also includes a narrow channel 291 through which bump 232 of blade 202 passes as blade 202 pivots between the retracted and extended positions. Note lock block 210 engages a projection 292 of blade 202 such that blade 202 is retained in the retracted position, and blade 202 can be moved from such position only upon the user pulling rearwardly on thumb button 226.

The provision of projection 265 on the upper, forward portion of tang 214 allows for full contact to be made therewith by blade stop screw 262, through a wide range of extensions of blade stop screw 262 from threaded bore 264.

Figure 8:
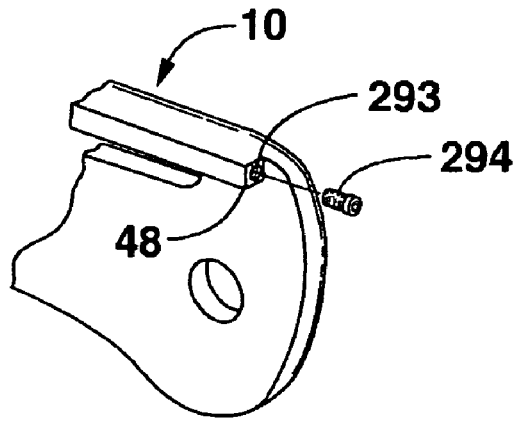
FIG. 8 is a perspective view, with parts cut away, of an adjustable blade stop for use in connection the embodiments shown in FIGS. 1 through 3F.

FIG. 8 illustrates an alternate embodiment of knife 10, discussed above, wherein a threaded bore 293 is provided in stop 48, and a blade stop screw 294 is provided therein for adjusting the effective blade stop with respect to stop 46 on tang T of blade B. Again, the provision of an adjustable blade stop screw 294 allows for removal of play in the blade when in the extended position. The adjustment screw 294 also may allow adjustment of the interaction of locking member 32 of knife 10 with respect to projection 44 (FIG. 3A).

Figure 9:
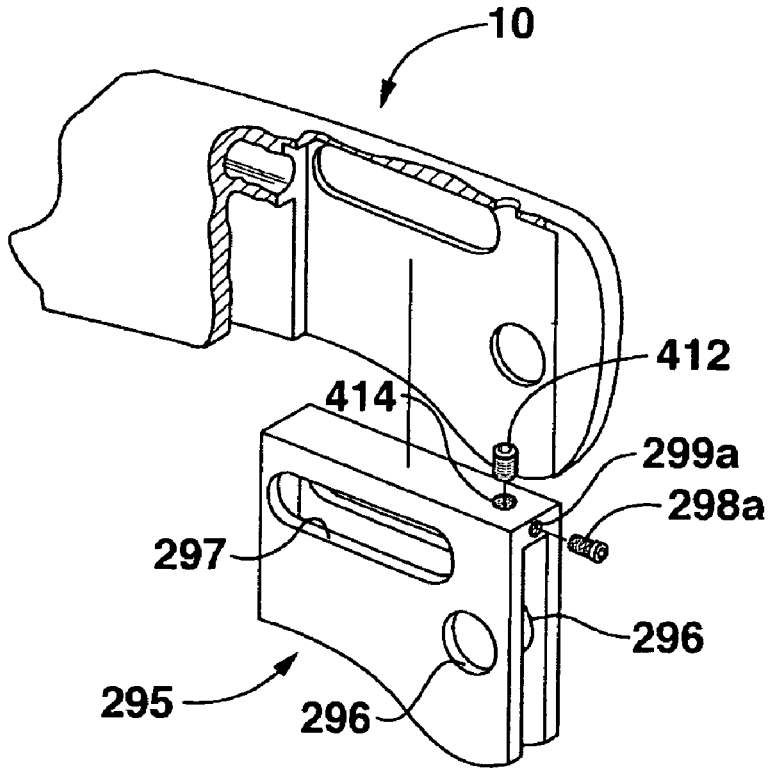
FIG. 9 is a perspective view, with parts cut away, of a further alternate embodiment of the locking folding knife shown in FIGS. 1 through 3F having a harness member with an adjustable blade stop screw.

FIG. 9 illustrates an insert, or, harness, generally 296, preferably constructed of metal, which can be used in knife 10, particularly if the handle of knife 10 is formed from materials such as plastic, bone, wood, or some other material lacking the structural integrity of steel, titanium, or some other metal. Harness 295 is generally U-shaped in cross-section and includes bores 296 for receipt of the pivotal connector P (FIG. 2). Harness 295 also includes an elongated slot 297 on each side for cooperating with slots S in knife 10 for allowing movement of locking member 32.

Harness 295 allows for improved strength in a knife having handles made of lighter or less strong material, such as injected molded polymer. Blade stop adjusting screw 298 can also be provided in a threaded bore 299 of harness 295 in order to allow for fine adjustment of the blade stop with respect to stop 46 of blade B. Further, the position of the blade stop adjusting screw 298 allows the degree of actuation of lock member 32 to be adjusted.

Where the handle of knife 10 is to be molded, harness 295 could be positioned in the mold during the molding process, or after the handle has been molded, in which case it could be secured in place with pivotal connector P. Harness 295 could also be used in knife 200 and knives 300 and 400 (discussed below), although in such knives the side slots 297 would not be necessary.

Figure 10:
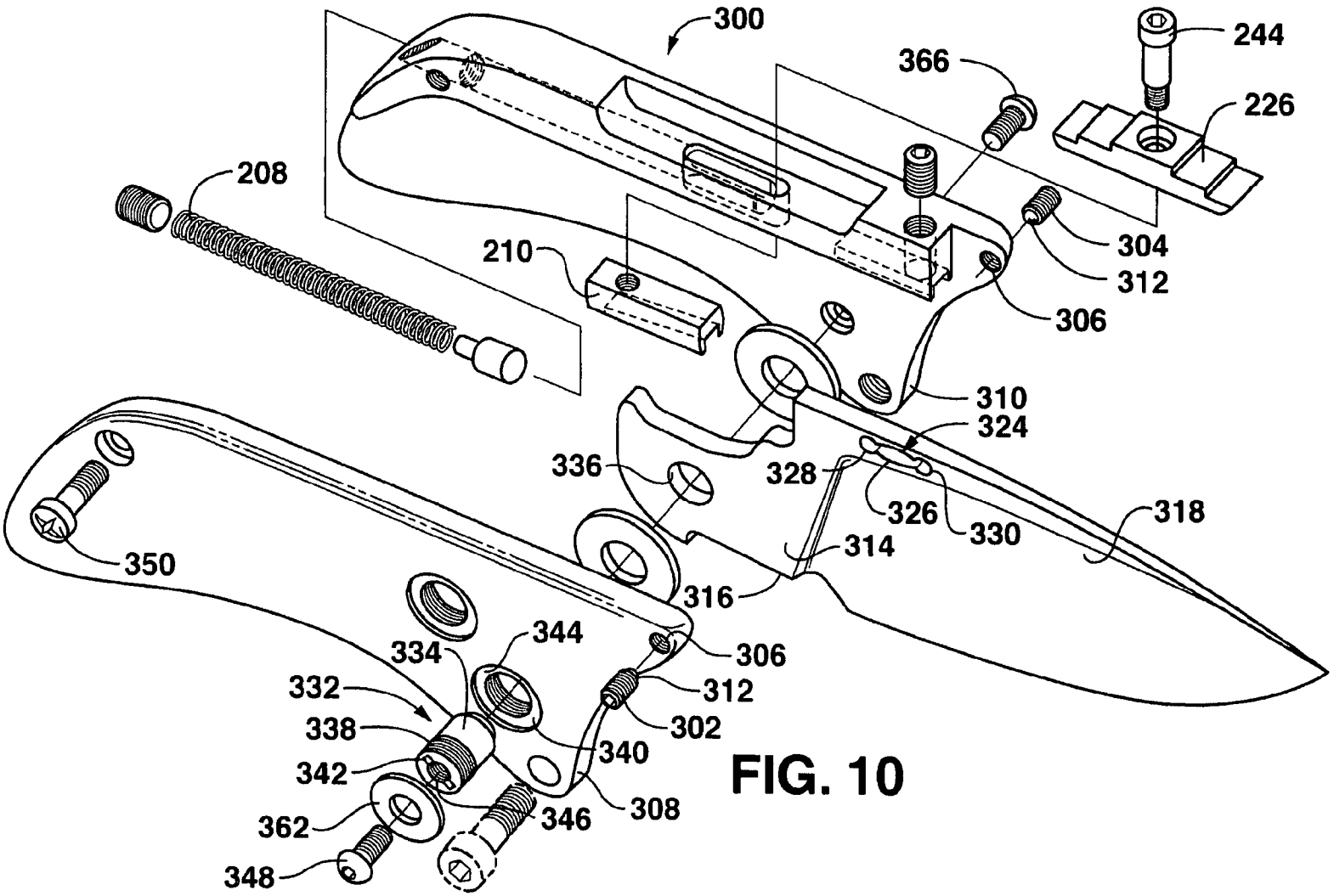
FIG. 10 is an exploded view of yet another alternate embodiment of a folding knife constructed in accordance with the present invention.

FIG. 10 illustrates a further alternate embodiment folding knife 300 constructed in accordance with the present invention. Knife 300 is very similar to knife 200, with the identical components bearing the same reference numerals. As shown in FIG. 10, knife 300 includes lateral stabilizer screws 302, 304 provided in threaded bores 306 in each handle member 308, 310.

Lateral stabilizer screws 302, 304 have hemispherically shaped tips 312 which bear against the side surfaces 314 of tang 316 as blade 318 moves between the retracted and extended positions. Lateral stabilizer screws 302, 304 add strength to knife 300 when lateral forces are applied against blade 318 and serve to distribute the load of lateral pressure on the tang 316 at additional points against the handle members 308, 310, rather than solely at the pivot axle of the blade 318 bearing all of such force.

Blade 318 also includes a blade hole, generally 324, having an elongated slot 326 with two generally circularly shaped end openings 328, 330. End openings 328, 330 could be provided with a post 260, as discussed above, to allow engagement by user's thumb or finger in order to open the blade 318. Alternately, the user could use the elongated slot 326, between the end openings 328, 330 in order to gain purchase with his or her thumb or finger for moving the blade from the retracted to the extended position.

Knife 300 includes an adjustable bushing, generally 332, having a shoulder portion 334, which acts as the axle about which blade 318 pivots through receipt of bushing shoulder 334 within bore 336 of blade 318. Bushing 332 also includes a threaded portion 338 for engagement with a threaded bore 340 in handle member 310. A drive profile, such as a slotted head 342, is provided bushing 332 to allow use of a screwdriver for installing bushing 332 within a countersunk hole 344 adjacent threaded bore 340. Bushing 332 also carries an internally threaded hole 346 for receipt of a screw 348. Screw 350 is used for assembling handle members to one another.

Figure 12:
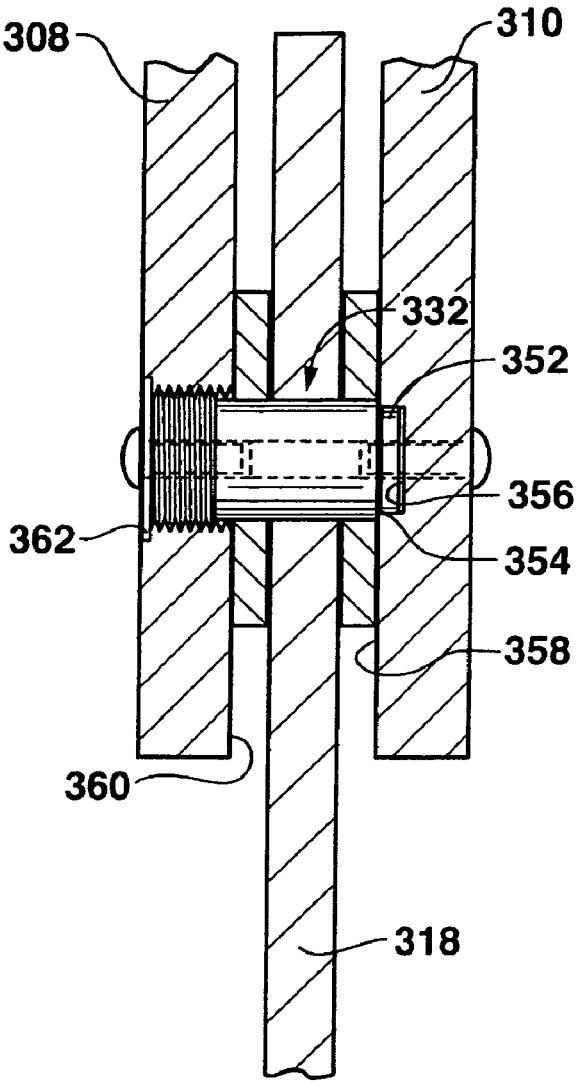
FIG. 12 is a sectional view of an adjustable bushing used in the alternate embodiment locking folding knife shown in FIG. 10.
Figure 13:
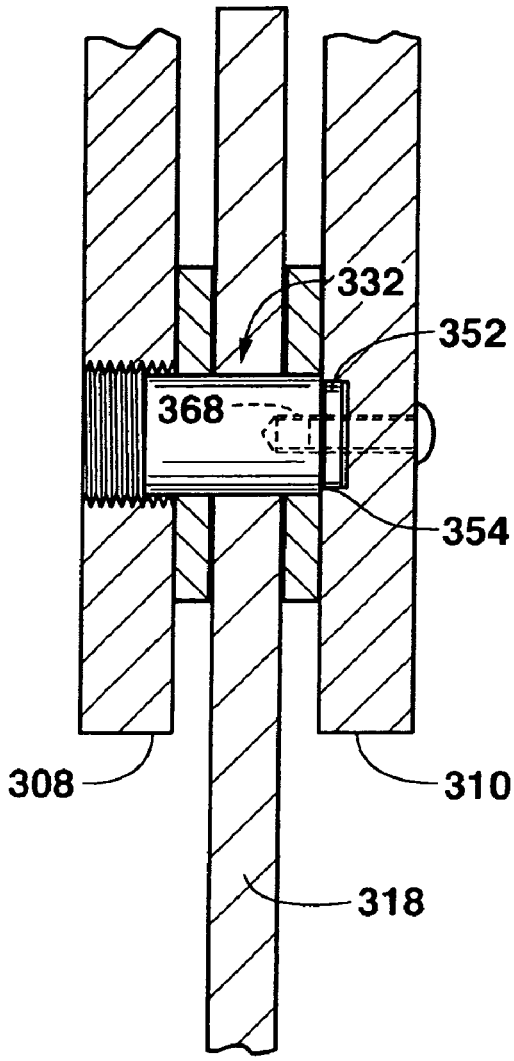
FIG. 13 is an alternate embodiment of the adjustable bushing illustrated in FIG. 12.

Adjustable bushing 332 includes, as shown in FIGS. 12 and 13, a reduced portion 352 and shoulder portion 354 adjacent reduced portion 352 for engagement with a hole 356 in handle member 310. Shoulder 354 bears on the surface of inner handle face 358 adjacent hole 356.

The purpose of bushing 332 is to act as the axle for the pivoting of blade 318, and also to allow proper spacing between the inner handle faces 358, 360 of handle members 308, 310, respectively. Should the spacing between faces 358, 360 be too great, blade 318 would be loose, and movable laterally to and fro with respect handle members 308, 310. If faces 358, 360 are too close to one another, then blade 318 will bind as it moves between the retracted and extended positions. Thus, once bushing 332 has been installed, it can be rotated within bore 336 in order to properly space faces 358, 360 from one another.

Washer 362 can be used in order to prevent dirt and debris from entering into threaded bore 336, and also for cosmetic purposes to cover the opening of threaded bore 336. Washer 362 is held in place by screw 348.

FIG. 13 illustrates an embodiment of bushing 332 where neither washer 362 nor screw 348 is used. Screw 366 is inserted into internal threaded bore 368 in the end of bushing 332 opposite internal threaded bore 346 in order to further secure bushing 332 in place, and as an axle for movement of blade 318.

Figure 11:
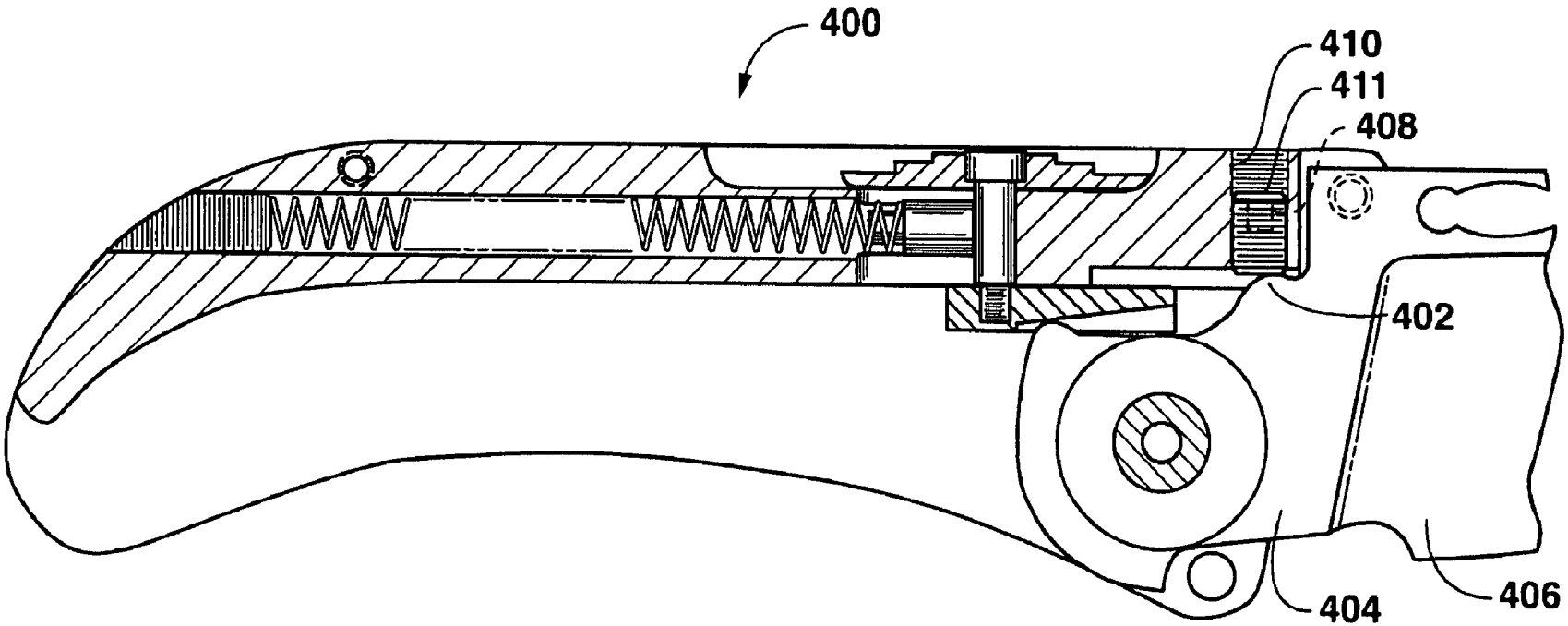
FIG. 11 is a sectional view of another alternate embodiment locking folding knife constructed in accordance with the present invention, with the blade being in the extended position.

FIG. 11 illustrates a further alternate embodiment folding knife 400 constructed in accordance with the present invention. In this embodiment, a projection 402 is provided on an upper, generally horizontal edge of tang 404 of blade 406. A generally vertically disposed blade stop screw 408 carried in threaded bore 410 bears against projection 402 when blade 406 is in the extended position, much in the same manner as discussed above with regards to knife 200, wherein stop screw 262 bears against projection 264. A plug 411 could be inserted into the upper end of screw 408, if desired. As with the blade stop screws discussed above, stop screw 408 can be used to adjust out play in the blade 406 when in the extended position. The harness 295, as shown in FIG. 9, includes a vertically disposed blade stop screw 412 received in threaded bore 414, thereby allowing harness 295 to be used in knife 400, if desired.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

The invention claimed is:

1. A folding knife, comprising:

an elongated handle having a first outer surface and a second outer surface; said elongated handle defining a longitudinally extending channel and a transverse opening extending from said first outer surface of said handle to said second outer surface of said handle;

an elongated blade having a tang portion carrying a pivotal connector connected to said handle; said blade being configured to pivot about said pivotal connector between a retracted position and an extended position with respect to said handle;

said blade including an upstanding tang projection in said tang portion;

a locking member carried for generally rectilinear movement in said transverse opening between a locking position and a release position;

said locking member extending generally from said first outer surface of said handle to said second outer surface of said handle and having an upper surface and a lower surface, said lower surface defining a generally ramped-shaped portion configured for contacting said tang projection upon said blade being in said extended position in order to lock said blade in said extended position;

biasing means carried in said longitudinally extending channel for biasing said locking member towards said locking position; and a connecting arm pivotally connected to said locking member and connected to said biasing means.

2. The folding knife as defined in claim 1, wherein said biasing means is a coil spring.

3. The folding knife as defined in claim 1, wherein said ramp-shaped portion of said locking member is configured to extend beyond said tang projection, towards said pivotal connector, upon said locking member being in said locking position.

4. The folding knife as defined in claim 1, further comprising said tang portion defining an engagement profile, and wherein said locking member is configured to move into said engagement profile upon said blade being in said retracted position to selectively lock said blade in said retracted position.

5. The folding knife as defined in claim 1, wherein said locking member includes a first projection projecting outwardly from said first outer surface and a second projection projecting outwardly from said second outer surface.

6. A folding knife, comprising:

an elongated handle having a first outer surface and a second outer surface; said elongated handle defining a longitudinally extending channel and a transverse opening extending from said first outer surface of said handle to said second outer surface of said handle;

an elongated blade having a tang portion carrying a pivotal connector connected to said handle; said blade being configured to pivot about said pivotal connector between a retracted position and an extended position with respect to said handle;

said blade including an upstanding tang projection in said tang portion, and said tang defining an engagement profile;

a locking member carried for generally rectilinear movement in said transverse opening between a locking position and a release position;

said locking member extending generally from said first outer surface of said handle to said second outer surface of said handle and having an upper surface and a lower surface, said lower surface defining a generally ramped-shaped portion configured for contacting said tang projection and for extending beyond said tang projection, towards said pivotal connector, upon said locking member being in said locking position to lock said blade in said extended position;

said locking member being configured for contacting said engagement profile of said tang portion, upon said locking member being in said locking position to lock said blade in said retracted position;

said locking member including a first projection projecting outwardly from said first outer surface and a second projection projecting outwardly from said second outer surface;

a spring carried in said longitudinally extending channel for biasing said locking member towards said locking position; and a connecting arm pivotally connected to said locking member and connected to said spring.

* * * * *